US005102045A

United States Patent [19]

Diana

[11] Patent Number: 5,102,045

[45] Date of Patent: Apr. 7, 1992

[54] APPARATUS FOR AND METHOD OF METERING COATING MATERIAL IN AN ELECTROSTATIC SPRAYING SYSTEM

[75] Inventor: Michael J. Diana, West Dundee, Ill.

[73] Assignee: Binks Manufacturing Company, Franklin Park, Ill.

[21] Appl. No.: 661,519

[22] Filed: Feb. 26, 1991

[51] Int. Cl.[5] ..... B05B 5/02; B05B 17/04

[52] U.S. Cl. ..... 239/3; 239/68; 239/69; 239/112; 239/691; 118/302; 118/629; 427/27

[58] Field of Search ..... 239/3, 690, 691, 703, 239/708, 68, 69, 104, 112, 113, 124, 305; 118/302, 629; 427/27

[56] References Cited

U.S. PATENT DOCUMENTS

| | | | |
|---|---|---|---|
| 3,674,205 | 7/1972 | Kock | 239/112 |
| 4,337,282 | 6/1982 | Springer | 239/112 |
| 4,592,305 | 6/1986 | Scharfenberger | 239/112 |
| 4,878,454 | 11/1989 | Cann | 239/112 |
| 4,879,137 | 11/1989 | Behr et al. | 239/112 |
| 4,932,589 | 6/1990 | Diana | 239/112 |
| 4,962,724 | 10/1990 | Prus et al. | 239/68 |

*Primary Examiner*—Andres Kashnikow
*Assistant Examiner*—Karen B. Merritt
*Attorney, Agent, or Firm*—Juettner Pyle & Lloyd

[57] ABSTRACT

An electrostatic spray coating system has a reservoir into which a metered quantity of electrically conductive paint is flowed from a grounded color changer and through a first flow meter. After filling the reservoir, at least a portion of the flow path between the reservoir and the color changer is cleaned of paint to electrically isolate the reservoir and paint therein from the color changer. The paint in the reservoir is then flowed through a second flow meter to an electrostatic spray gun. The second flow meter is electrically isolated from ground and is used to compare the quantity of paint delivered to the spray gun to the quantity of paint loaded into the reservoir, as well as to monitor and control the volume flow rate of paint from the reservoir to the spray gun. The arrangement makes it possible to spray substantially all of the paint flowed into the reservoir and to accurately control the flow rate of paint to the spray gun.

16 Claims, 4 Drawing Sheets

APPARATUS FOR AND METHOD OF METERING COATING MATERIAL IN AN ELECTROSTATIC SPRAYING SYSTEM

BACKGROUND OF THE INVENTION

The present invention relates to metering liquid coating material flow in a voltage block type color change system which delivers coating material to an electrostatic spraying apparatus.

Color changers for spray coating apparatus have application in industrial operations where articles are to be spray coated at a station or as they move along a production line. Where the articles are to be coated with a wide variety of colors, it generally is not practical to establish separate spray stations or production lines for each color, or even to spray a long sequence of articles one color, then another long sequence a second color, etc. Instead, it is desirable to be able to make color changes rapidly and simply at a single station.

Electrostatic spray coating devices have an increased painting efficiency over nonelectrostatic types. When painting with an electrostatic spraying apparatus, it is necessary to have some means for applying a charge to the paint. In some apparatus, charging is accomplished by an electrode connected to a high voltage supply and placed in close proximity to or in contact with the paint either just prior or close to its point of atomization. In rotary atomization apparatus, the rotary atomizer is ordinarily made of a conductive material and connected to the power supply, so the atomizer itself is the electrode. Whichever type of apparatus is used, the charging potential usually is on the order of several tens of kilovolts. The electrostatic charging process works well when spraying nonconductive paints, but when spraying conductive paints, such as waterborne paints, precautions must be taken to prevent the high voltage at the spraying apparatus from shorting to ground through the conductive column of paint being delivered to the spraying apparatus.

One known approach to prevent shorting the high voltage to ground is to isolate the entire paint supply and color change system from ground potential. This allows the paint system to "float" at the charging potential, but has the drawback that a large amount of electrical energy is capacitively stored in the system. To prevent the capacitively stored energy from presenting a shock hazard to operating personnel, it is necessary to provide a protective enclosure around the color changer and paint supplies, which increases costs and requires that the spraying operation be shut down and the system electrically discharged whenever it is necessary to replenish the supplies of paint. Also, the large amount of capacitively stored energy increases the probability of arcing and the possibility of an explosion when volatile materials are sprayed.

Another approach that can be used with relatively nonconductive paint, is to ground the paint supplies and color changer and connect the spraying apparatus to the color changer through a hose of sufficient length that the electrical resistance of the paint column in the hose is large enough to reduce current leakage through the paint column to a level that does not short out the charging voltage or cause it to fall to an unacceptably low level. A disadvantage of the technique is that a long hose is difficult to clean during color changes. Also, while the extended length of the hose limits the magnitude of leakage current, some leakage nonetheless occurs and represents "wasted" charging energy. For relatively conductive coating materials such as waterborne paints, the resistance of the paint is so low that the technique is not practical.

A more recent approach to electrostatically spraying waterborne paints contemplates utilizing a voltage block, which is some means for interrupting the electrically conductive path that would otherwise exist between an electrostatic spray gun and a grounded paint supply, in order to spray waterborne paint electrostatically without grounding out the high electrostatic charging voltage. An exemplary embodiment of such a voltage block is disclosed in Michael J. Diana U.S. Pat. No. 4,932,589, assigned to the assignee of the present invention. Said Diana patent discloses an apparatus for supplying conductive paint from a grounded color changer to an electrostatic spray gun while electrically isolating the color changer from a high voltage at the gun. The apparatus has a reservoir into which a metered quantity of paint to be sprayed is introduced. After filling the reservoir with paint and prior to delivering the paint to the spray gun, the flow path between the reservoir and color changer is cleaned to electrically isolate the reservoir and paint therein from the grounded color changer. The paint is then delivered from the reservoir to the spray gun for being emitted in an electrostatically charged atomized spray. At the end of spraying, the high voltage is turned off and the reservoir is cleaned and reloaded with another color of paint. To minimize the time required between color changes, the apparatus advantageously has two reservoirs that alternately receive and deliver selected colors of paint to the spray gun, such that one reservoir is cleaned and reloaded with paint while the other delivers paint to the spray gun.

Another voltage block type color change system in which reservoirs are used is disclosed in Elberson et al. U.S. Pat. No. 4,792,092.

In the voltage block type color change systems disclosed in said Diana and Elberson et al. patents, a metered quantity of paint is flowed into a reservoir for delivery to an electrostatic spray gun. However, neither patent discloses any means for delivering substantially all of the paint in the reservoir to the spray gun while ensuring that the paint supply is not fully depleted, which could result in the introduction of air into the spray gun and "spitting" of paint from the gun. Also, neither patent teaches any means for ensuring delivery of paint from the reservoir to the spray gun at an accurately controlled volume flow rate. Consequently, in each of the systems, increased costs for paint are incurred since it often happens that an excess quantity of paint remains behind at the end of a spraying operation, and in neither is there precise control over the deposition rate of paint on an article.

OBJECTS OF THE INVENTION

An object of the invention is to provide a voltage block type color change system in which a metered volume of coating material is flowed from a grounded color changer into a reservoir from which the coating material is delivered to an electrostatic spray coating apparatus, in which the volume of coating material flowed into the reservoir is compared to the volume of coating material delivered to the spray coating apparatus to ensure that the substantial entirety of the coating material flowed into the reservoir is delivered to the coating apparatus.

Another object is to provide such a system in which a flow meter is located between the reservoir and the spray coating apparatus to meter the volume flow and the volume flow rate of coating material delivered from the reservoir to the coating apparatus.

A further object is to provide such a system in which there are two reservoirs for alternately receiving and delivering selected colors of coating material to the spray coating apparatus and in which the flow meter is located between each of the reservoirs and the spray coating apparatus.

SUMMARY OF THE INVENTION

In accordance with the present invention, a system for supplying electrically conductive coating material to high voltage electrostatic coating apparatus comprises means for supplying conductive coating material, a reservoir, means for coupling the means for supplying to the reservoir, and means for operating the means for supplying to flow coating material through the coupling means into the reservoir. Also included are first metering means for metering the volume of coating material flowed into the reservoir; means, operative after coating material is flowed into the reservoir, for cleaning coating material from at least a portion of the coupling means to electrically isolate the reservoir and coating material therein from the supplying means, and means, operative after the reservoir has been electrically isolated from the supplying means, for flowing coating material from the reservoir to the coating apparatus for being electrostatically charged and emitted thereby. In addition, included are second metering means for metering the volume of coating material flowed from the reservoir to the coating apparatus, and means for interrupting the flow of coating material from the reservoir to the coating apparatus upon the second metering means metering a selected volume flow of coating material from the reservoir to the coating apparatus.

The invention also contemplates a method of supplying electrically conductive coating material to high voltage electrostatic coating apparatus from a coating material supply having an outlet for the coating material, while maintaining electrical isolation between the high voltage at the coating apparatus and the coating material supply. The method comprises the steps of coupling the coating material supply outlet to a reservoir through a supply path, connecting the reservoir to the coating apparatus through a delivery path, operating the coating material supply to flow coating material from the coating material supply outlet into and through the supply path to and into the reservoir, and measuring the volume of coating material flowed through the supply path into the reservoir. Also included are the steps of cleaning coating material from at least a portion of the supply path between the coating material supply outlet and the reservoir to electrically isolate coating material in the reservoir from the coating material supply and, after completion of the cleaning step, delivering coating material in the reservoir through the delivery path to the coating apparatus for being electrostatically charged and emitted by the coating apparatus. In addition, included are the steps of metering the volume of coating material delivered from the reservoir to the coating apparatus, and interrupting delivery of coating material from the reservoir to the coating apparatus upon metering a selected volume of coating material delivered from the reservoir to the coating apparatus.

The foregoing and other objects, advantages and features of the invention will become apparent upon a consideration of the following detailed description, when taken in conjunction with the accompanying drawings.

DETAILED DESCRIPTION

Figure 1B:
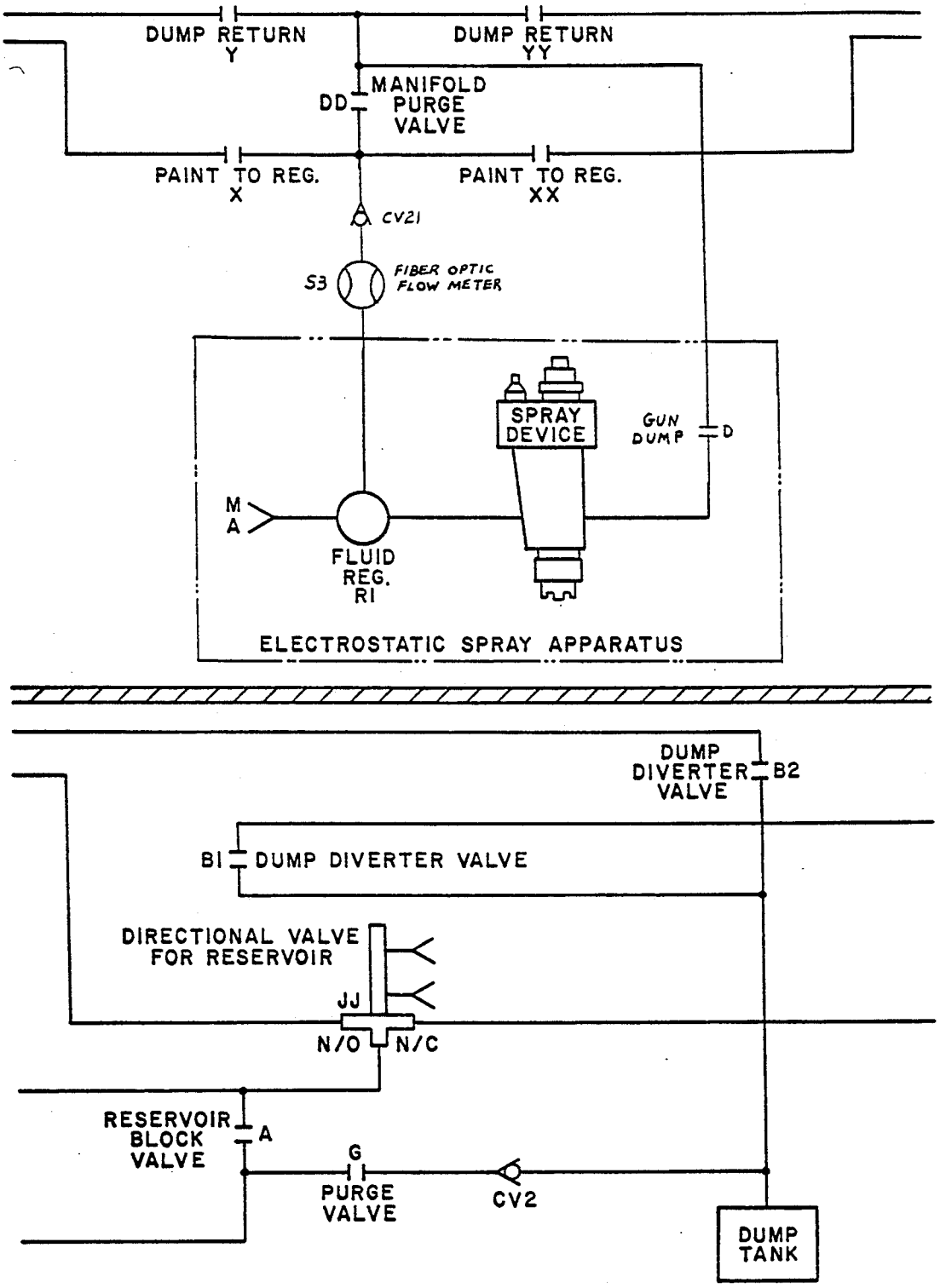
FIGS. 1 and 1A–1C schematically represent a voltage block type color change system for an electrostatic spray coating apparatus, which embodies the teachings of the present invention.
Figure 1A:
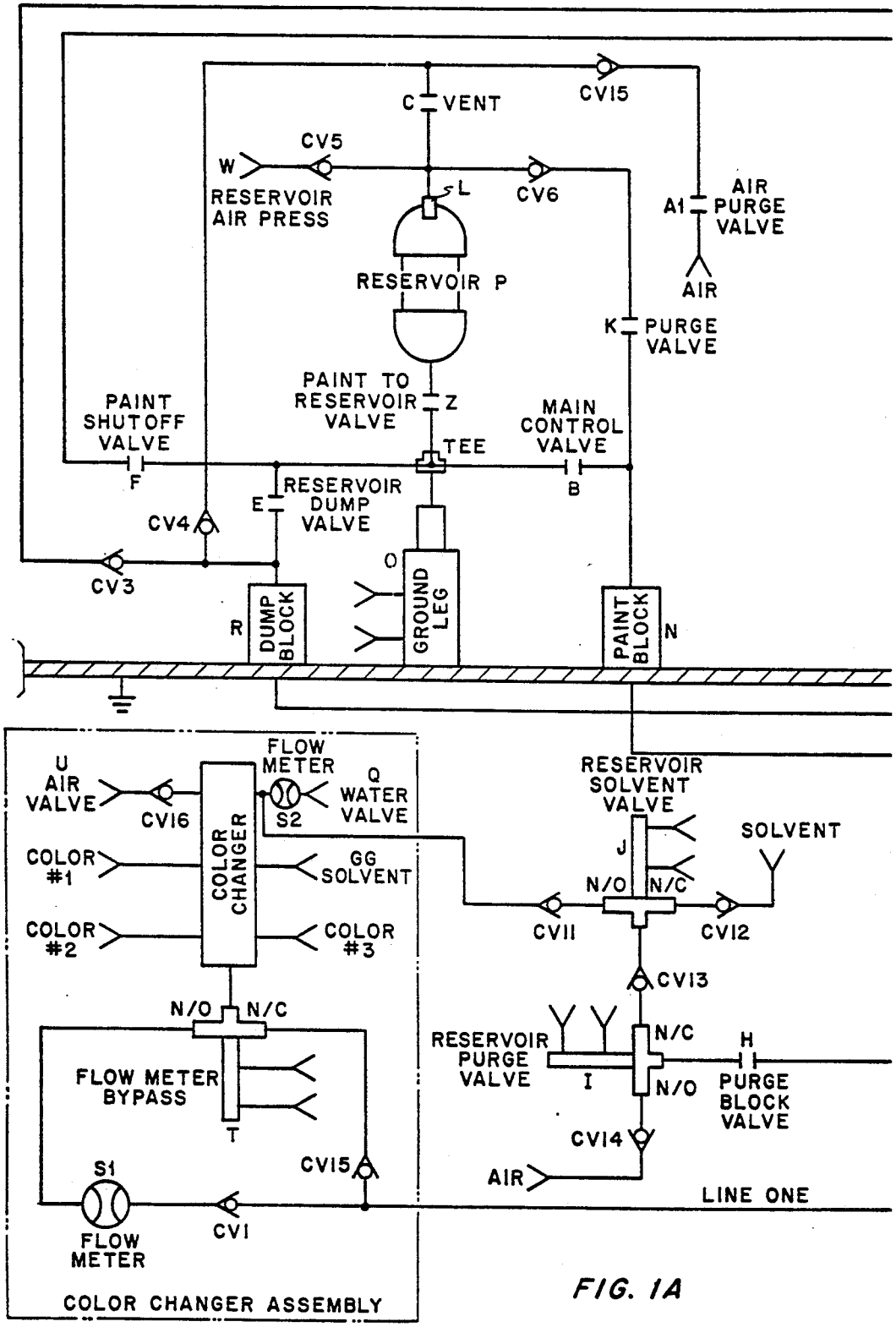
Figure 1C:
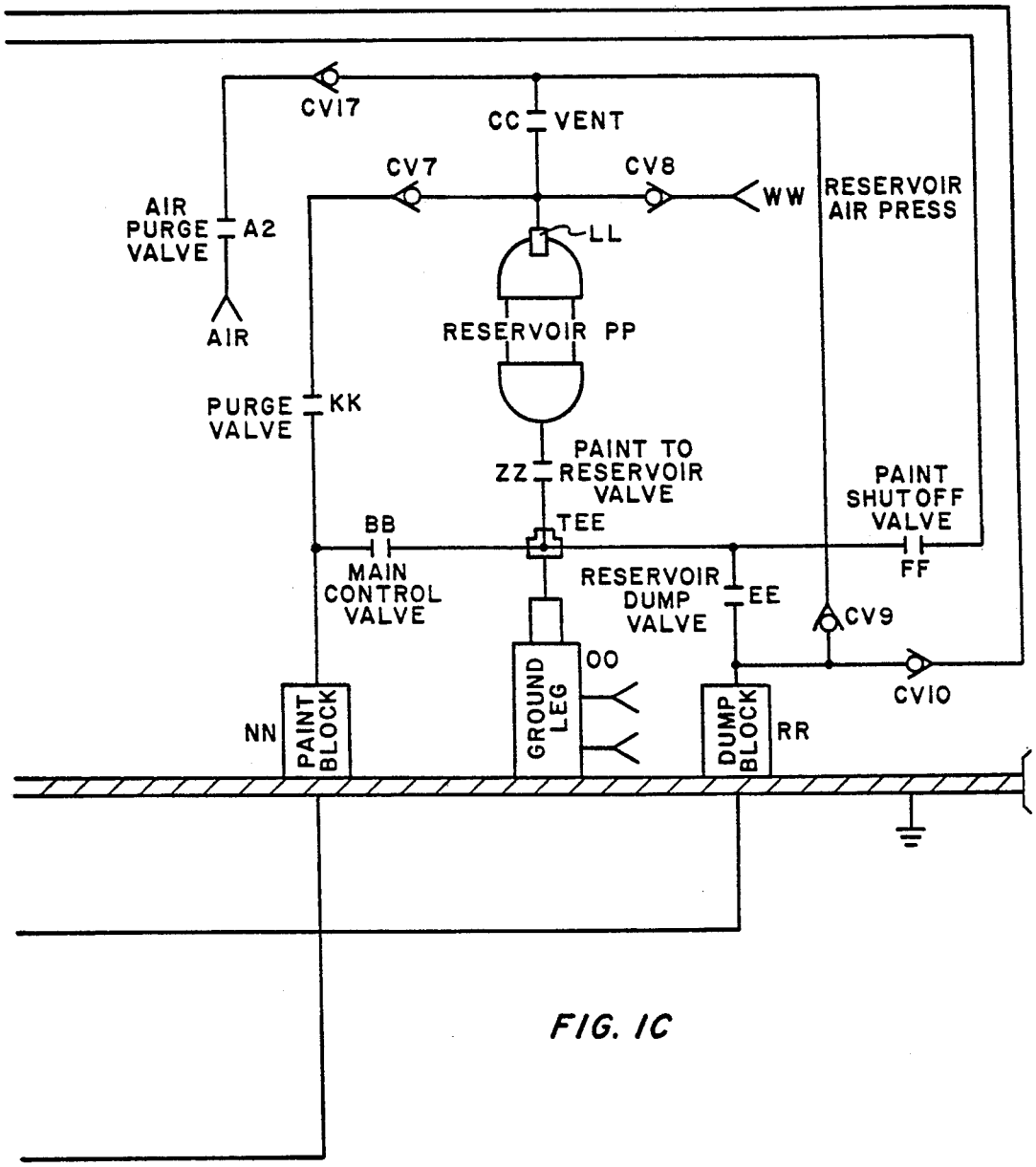
Figure 1:
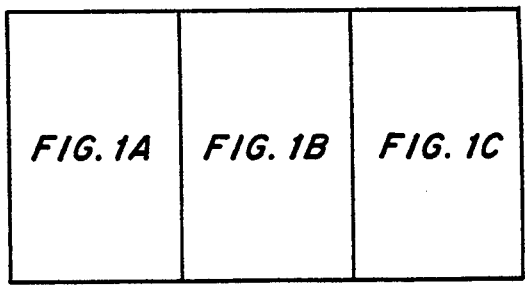

FIGS. 1A–1C show a high voltage electrostatic spray coating apparatus that includes a spray device or spray gun adapted to spray any one of a plurality of different colors of paint. Also included is a grounded color changer assembly that is operable to selectively supply any one of a number of different colors of paint to the spray apparatus. The color changer assembly is not connected directly to the spray apparatus, but rather is connected through an electrical isolation system or voltage block assembly. Paint provided by the color changer assembly may be electrically nonconductive, but the voltage block assembly advantageously enables it to supply electrically conductive paint to the spray apparatus, while maintaining electrical isolation of the grounded color changer and its paint supplies from the high voltage at the spray apparatus.

Except for a check valve CV21 and a fiber optic flow meter S3, to the extent that they are shown in FIGS. 1A–1C, the color changer assembly, isolation system or voltage block assembly and electrostatic spray apparatus are the same as are shown and described in Michael J. Diana U.S. Pat. No. 4,932,589, issued June 12, 1990, the teachings of which are incorporated herein by reference. Since the apparatus as taught in said patent provides an environment of a type in which the present invention may advantageously be used, such apparatus will first be considered by itself.

The isolation system has two appropriately sized reservoirs P and PP that are filled with metered volumes of selected colors of paint as required for specific jobs. A single reservoir may be used, but by using at least two, the time required to change colors of paint delivered to the spray apparatus is reduced. The two reservoirs are alternately charged with and deliver selected colors of paint to the spray apparatus. Once a reservoir is filled with paint, it is electrically isolated from the color changer and paint supplies by cleaning the fluid flow path between it and the color changer. For safety purposes, pneumatically operated ground legs O and OO are attached to the reservoirs to selectively ground them and their contents during fill and purge cycles. While paint is being delivered from a reservoir to the spray gun, its ground leg removes ground from it and its contents to prevent the high charging voltage at the gun from being shorted out. For safety, the only time a reservoir and its contents are not grounded is when the reservoir is delivering paint to the spray gun and a high electrostatic charging voltage is present at the gun. While paint in one reservoir is being delivered to the spray apparatus, the other reservoir is flushed clean of the color of paint it previously delivered and is then refilled with a metered volume of the next color of paint to be delivered. These simultaneous paint delivery and cleaning actions enable short duration purge and fill times between color changes.

The isolation system is positioned between a grounded conventional color changer assembly and a conventional electrostatic spray coating apparatus. As seen in FIGS. 1A-1C, the color changer assembly includes a color changer having a plurality of valved inlets connected to grounded supplies of different colors of conductive paints or coating materials, which as described are waterborne paints and of which colors 1, 2 and 3 represent three of a large number of different colors. The color changer operates in a known manner to supply any selected one of the colors of paint at its outlet. The color changer has a valved water inlet Q connected to a source of water through a flow meter S2, a valved air inlet U that includes a check valve CV16 and a valved chemical solvent inlet GG. An outlet from the color changer connects to an inlet to a flow meter bypass valve T, a normally closed outlet from which connects through a check valve CV15 to a LINE ONE of the voltage block assembly and a normally open outlet from which connects through a flow meter S1 and a check valve CV1 to the LINE ONE.

The color changer assembly provides selected colors of paint through the isolation system or voltage block assembly to the electrostatic spray apparatus, which as shown includes an electrostatic spray device or spray gun, a pneumatically controlled fluid regulator R1 for controlling the pressure of paint delivered to an inlet to the gun in accordance with the value of a pneumatic signal at a control inlet to the regulator, and a pneumatically controlled gun dump valve D in line with a flush outlet from the gun.

The isolation system connects between the color changer assembly and the spray apparatus to convey selected colors of conductive paint from the color changer assembly to the spray apparatus while maintaining electrical isolation between the grounded color changer and the high charging voltage at the spray apparatus. The isolation system includes a plurality of pneumatically controlled valves and fluid lines or hoses of electrically insulating material. The LINE ONE extends between the outlet from the color changer assembly and inlets to a reservoir block valve A and a color changer purge valve G. An outlet from the purge valve connects through a check valve CV2 to a dump tank and an outlet from the reservoir block valve connects to an inlet to a directional valve JJ for the reservoirs P and PP, which reservoirs also are of electrically insulating material. Also connected to the inlet to the directional valve is an outlet from a purge block valve H, an inlet to which connects to an outlet from a reservoir purge valve I. A normally open inlet to the reservoir purge valve connects through a check valve CV14 to a supply of air under pressure and a normally closed inlet connects through a check valve CV13 to an outlet from a reservoir solvent valve J. A normally open inlet to the solvent valve connects to the supply of water through a check valve CV11 and the flow meter S2, and a normally closed inlet connects through a check valve CV12 to a pressurized supply of solvent.

Downstream from the reservoir directional valve JJ the isolation system has two symmetrical parts, one including the reservoir P and the other the reservoir PP. The reservoirs receive metered volumes of paint for delivery to the spray apparatus, with each metered volume preferably being only that amount of paint necessary for a particular spraying operation. As will be described, paint is alternately delivered to the spray gun first from one reservoir and then from the other, and while one reservoir is delivering paint the other is being flushed clean of the paint it previously delivered. A normally open outlet from the reservoir directional valve JJ connects to the symmetrical part of the isolation system including the reservoir P and a normally closed outlet connects to the part including the reservoir PP.

The two symmetrical parts of the isolation system are identical, so only the part identified with single reference letters and including the reservoir P will be described, it being understood that a like description applies to the other part, the components of which are identified by similar but double reference letters. Accordingly, the normally open outlet from the reservoir directional valve JJ connects to an inlet to a paint block N, which is a manifold of electrically insulating material mounted on an electrically conductive and grounded platform. An outlet from the paint block connects to inlets to a main control valve B and a purge valve K. An outlet from the valve B connects through a tee of electrically conductive material to one side of a paint to reservoir valve Z and to inlets to each of a reservoir dump valve E and a paint shutoff valve F. Also connected to the tee and mounted on the grounded platform is the ground leg O, which is selectively deactuable and actuable to connect and disconnect the tee with and from ground potential.

An outlet from the paint shutoff valve F connects through a paint to regulator valve X (and through the check valve CV21 and the fiber optic flow meter S3) to an inlet to the fluid regulator R1 of the spray apparatus, the outlet from which connects to a paint inlet to the spray device. A dump or flush outlet from the spray device connects through the gun dump valve D, a dump return valve Y and a check valve CV3 to an inlet to a dump block R, which is a manifold of electrically insulating material mounted on the grounded platform. An outlet from the reservoir dump valve E also connects to the inlet to the dump block and an outlet from the dump block connects through a dump diverter valve B2 to the dump tank. Connected between the outlet from the valve X and the inlet to the valve Y is a manifold purge valve DD that is common to both symmetrical parts.

A lower inlet/outlet end of the reservoir P is connected through the valve Z to the electrically conductive tee. An upper inlet/outlet end of the reservoir includes a diffuser L that is connected to each of an outlet from the valve K through a check valve CV6, to a regulated reservoir air pressure valve W through a check valve CV5, to an air purge valve A1 through a vent valve C and a check valve CV15, and to the dump block R through the vent valve C and a check valve CV4.

The second symmetrical part of the isolation system is structured identically to the first part and its components are identified with double reference letters and correspond to components of the first part that are identified with the same but single reference letters. Also, check valves CV7, CV8, CV9, CV10 and CV17 of the second part correspond, respectively, to the check valves CV6, CV5, CV4, CV3 and CV15 of the first part; air purge valve A2 of the second part corresponds to the valve A1 of the first part; and a dump diverter valve B1 of the second part corresponds to the dump diverter valve B2 of the first part.

Considering operation of the isolation system in delivering paint from the grounded color changer assembly to the spray apparatus and in electrically isolating the color changer assembly and its associated paint supplies from the high voltage at the spray apparatus during a spraying operation, a first selected color of paint, for example color 1, is loaded into the reservoir P. This is accomplished by admitting paint of color 1 into the color changer while opening the valves A, B, Z, C and B2 to establish a flow path for color 1 from the color changer to and into the lower end of the reservoir P. The volume flow of paint is metered by the flow meter S1 and when it equals a predetermined volume, the color changer valve for color 1 is closed.

At this point, a column of paint of known volume extending between the color changer and the lower inlet to the reservoir P is pushed into the reservoir by opening the color changer water valve Q. The flow meter S2 meters the volume flow of water and when it equals a selected volume, the valves A, B, Z, C, B2 and Q are closed. The selected volume of water is such that a column of water then extends from the color changer to about the lower end of the reservoir. In pushing the column of paint to and into the reservoir, the water partially cleans the flow path between the color changer and the reservoir.

The column of water and paint residue in the flow path between the color changer and reservoir P are electrically conductive, so to electrically isolate the reservoir from the grounded color changer the flow path, including the paint block N, the dump block R and their associates lines, is flushed clean. This is accomplished by actuating the valves J, H, B, E and B2 to establish a flow path from the valve H and through the valve JJ, paint block N, valve B, tee, valve E, dump block R and valve B2 to the dump tank, while alternately actuating and deactuating the valve I to inject alternate bursts of solvent and air into and through the flow path to clean the path. After the valve I is cycled a number of times it is maintained deactuated, so that only air then flows through and dries the path to render it electrically nonconductive. This enables the paint in the reservoir P to be delivered to the spray device without grounding out the high voltage at the device through the column of paint.

While the reservoir P is being filled, the reservoir PP delivers to the spray device paint previously loaded into it. At the end of delivery of paint from the reservoir PP, the high voltage is removed from the spray device and the ground leg OO is deenergized to ground the reservoir PP and its contents. Paint remaining in the reservoir PP and the spray apparatus is then pushed out with air by actuating the valves H, JJ, KK, ZZ, FF, XX, D, YY and B1 to establish a flow path for air from the check valve CV14 and through the valves I, H, JJ, KK, the paint block NN and check valve CV7, into the upper end of the reservoir PP. The air pushes paint out of the lower end of the reservoir and through the valves ZZ, FF and XX, the regulator R1 and the spray device, during which time an override signal M is applied to the fluid regulator control inlet to cause the regulator to exhibit a minimum resistance to the flow of air and paint. From the spray device the air and paint move through the valves D and YY, check valve CV10, dump block RR and dump diverter valve B1 to the dump tank. This excess paint, which often amounts to two or more ounces of paint, is wasted.

Next, the paint supply and dump return lines leading to and from the spray apparatus are flushed clean by actuating the valves J, H, JJ, BB, FF, XX, D, YY and B1 while applying the override signal M to the control input to the fluid regulator R1. Simultaneously, the valve I is alternately actuated and deactuated to cause alternate bursts of air and solvent to flow through a path comprising the valves H and JJ, paint block NN, valves BB, FF and XX, fluid regulator R1, spray device, valves D and YY, check valve CV10, dump block RR and valve B1 to the dump tank to clean the path, following which the valve I remains deactuated so that only air flows through and dries the path to render it electrically nonconductive.

After the spray apparatus is cleaned of paint from the reservoir PP, the paint loaded into the reservoir P is rapidly flowed to the spray apparatus by actuating the valves H and K to introduce air from the valve I into the upper end of the reservoir P while simultaneously actuating the valves Z, F, X, D, YY and B1 and applying the override signal M to the regulator R1. The valves H, K, D, YY and B1 are actuated for a time sufficient for paint to flow from the lower end of the reservoir P to the inlet to the spray device, and are then deactuated.

With the valves Z, F and X remaining actuated and open, high pressure air is then introduced into the reservoir P by opening the valve W, to push paint from the reservoir to the spray device. Simultaneously, a signal A is applied at the control or pilot inlet to the regulator R1 to cause paint to be supplied at a selected pressure to the spray device, the ground leg O is actuated to unground the reservoir and paint therein, a high voltage is applied to the spray device and a valve in the spray device is opened to emit paint from the device in an electrostatically charged atomized spray. By virtue of the paint block N and dump block R having previously been cleaned and dried, although the high voltage at the spray device is coupled through a conductive column of paint to the paint in reservoir P, it is electrically isolated from the grounded color changer assembly and the other components of the isolation system located between the color changer assembly and the paint and dump blocks.

While spraying paint from the reservoir P, the color changer assembly and LINE ONE are cleaned by opening the valve G to establish a path through the LINE ONE and check valve CV2 to the dump tank while operating the color changer air valve U and water valve Q to alternately introduce bursts of air and water through the color changer assembly and the LINE ONE. The flow meter bypass valve T is actuated when the air valve U is opened and deactuated when the water valve Q is opened, so that only water flows through the flow meter S1, as passing air through it could cause its sensing elements to be overdriven and damaged.

Also while paint from the reservoir P is being sprayed, the reservoir PP and its paint supply and dump return lines are cleaned. The valves H, JJ, KK, ZZ, EE and B1 are first actuated to flow air through a path that includes the check valve CV14, paint block NN, check valve CV7, reservoir PP, dump block RR and dump tank. The valves I and J are then actuated to flow solvent through the path, with a diffuser LL in the upper end of the reservoir uniformly distributing solvent downwardly across the inner reservoir walls. The valves BB and CC are then briefly actuated and the valves KK and EE are deactuated, so that solvent flows upwardly into the reservoir. Next, the valve KK is again actuated and the valves BB and CC are deactuated, so that solvent again flows into the upper end of and downwardly through the reservoir, after which the valve I is controlled to cause a burst of air followed by a burst of solvent to flow through the reservoir, followed by a flow of air.

After being cleaned, the reservoir PP is filled with the next color of paint to be delivered, for example color 2. The color changer inlet valve for color 2 is opened, as are the valves A, JJ, BB, ZZ, CC and B1, to flow paint of color 2 into the reservoir PP until the flow meter S1 senses that a preselected volume of paint has passed through it, at which point the color changer inlet valve for color 2 is closed. The color changer valve Q is then actuated so that water pushes the column of paint extending between the color changer and reservoir to and into the reservoir, in a manner similar to that which occurred during charging of the reservoir P with paint. When a predetermined volume flow of water is measured by the flow meter S2, the valves A, BB, ZZ, CC, B1 and Q are deenergized.

After the reservoir PP is charged with paint of color 2, the paint and dump blocks NN and RR and their associated fluid lines and valves are flushed and dried to electrically isolate the reservoir from the color changer assembly. This is accomplished by actuating the valves J, H, JJ, BB, EE and B1 while operating the valve I to alternately introduce bursts of solvent and air through the paint and dump blocks and their associated lines and valves. The air purge valve A2 also is briefly energized to clear any fluid trapped in the vent valve CC. After several actuations and deactuations the valve I is maintained deactuated so that air flows through and dries the components.

Upon completion of delivery of paint from the reservoir P to the spray apparatus, the ground leg O is deactuated to ground the reservoir and its contents and excess paint remaining in the reservoir, in the delivery line to the spray device and in the spray device itself is pushed out with air. This is accomplished by actuating the valves H, K, Z, F, X, D, Y and B2 and by applying the override signal M to the pressure regulator control input. The air push occurs in a manner similar to that described in respect of the reservoir PP and the excess paint delivered to the dump tank, which often amounts to two or more ounces of paint, is wasted.

The lines to the reservoir P and the paint and dump return lines from the spray apparatus are then flushed by operating the valves J, I, H, B, F, X, D, Y and B2 and by applying the override signal M to the pressure regulator control input. The operation proceeds in a manner similar to that described in respect of the reservoir PP, and cleans the spray apparatus and the lines between it and the reservoir P of the color of paint previously delivered to it from the reservoir P.

The next color of paint to be sprayed, i.e., color 2 in the reservoir PP, is then flowed to the paint inlet to the spray device by operating the valves H, JJ, KK, ZZ, FF, XX, D, Y and B2 while applying the override signal M to the pressure regulator control input. The operation occurs in a manner similar to that described in connection with the reservoir P.

Paint is then sprayed from the reservoir PP by actuating the valves ZZ, FF and XX, by opening the valve WW to pressurize the reservoir with air and by selecting an appropriate paint pressure signal A for application to the control input to the pressure regulator R1. At this time, the ground leg OO is actuated to unground the reservoir, a high voltage is applied to the spray gun and the gun is actuated to emit an atomized spray of electrostatically charged paint.

While spraying paint from the reservoir PP, the color changer assembly, LINE ONE, reservoir P and lines associated with the reservoir are cleaned. This occurs by actuating the valves U, Q, T, G, I, J, H, B, K, Z, C, E and B2. Following the cleaning cycle, the reservoir P is charged with the next selected color of paint to be sprayed and the sequence of operations described are repeated for successive colors of paint.

Although the color changer assembly, isolation system and spray apparatus may be manually operated, their operations are most easily and conveniently performed automatically, such as by computer control. Also, while the operation of the system has been described for the situation where the color changer assembly supplies successive different colors of paint to be sprayed, the reservoirs could alternately be charged with the same color of paint.

To the extent thus far described, the system is the same as the one disclosed in said U.S. Pat. No. 4,932,589. Reference is made to said patent for a more detailed description of the system.

In improving upon the system shown in FIGS. 1A–1C and described in greater detail in said U.S. Pat. No. 4,932,589, the invention contemplates utilizing the flow meter S3 between the manifold purge valve DD and the fluid pressure regulator R1. The flow meter S3 is a fiber optic flow meter, i.e., one in which light signals representative of the metered flow rate and total volume flow of paint through the flow meter are transmitted from the flow meter to a flow computer through a fiber optic cable. The fiber optic cable is electrically nonconductive, so the high voltage connected from the spray device to the flow meter S3 through a conductive column of paint is electrically isolated from the flow computer.

Figure 2:
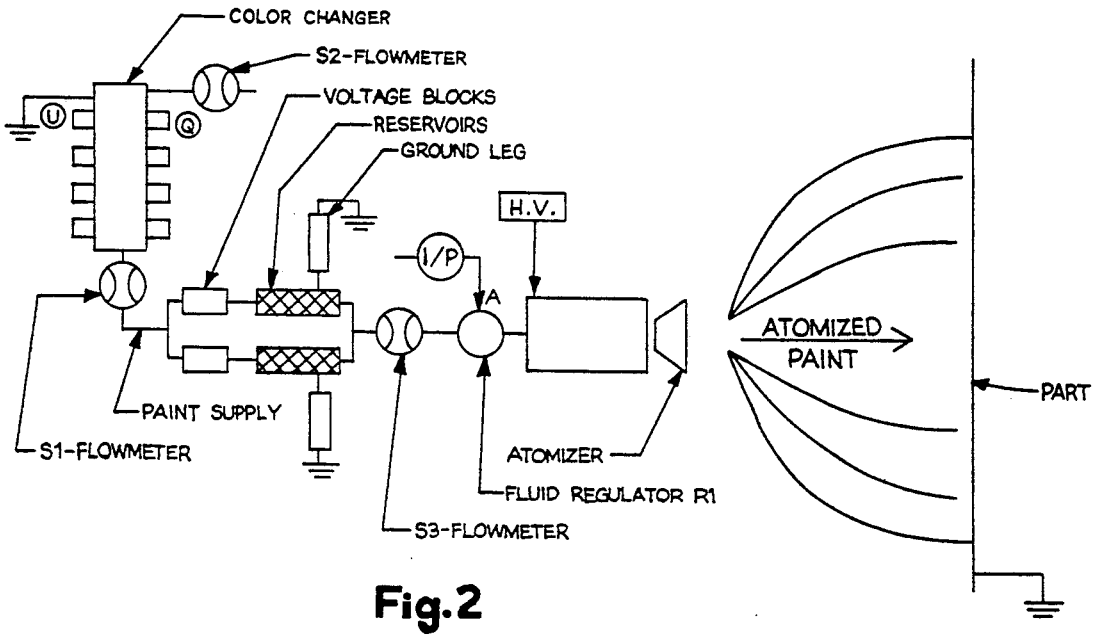
FIG. 2 is a highly simplified schematic representation of the system.
Figure 3:
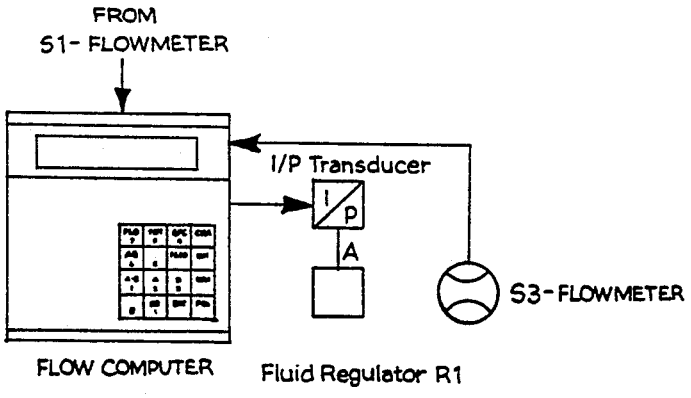
FIG. 3 shows the connection of a flow transmitter of the system to a flow computer.

Referring also to the simplified schematic representations of the improved system shown in FIGS. 2 and 3, the improved system uses all three of the flow meters S1, S2 and S3. The flow meter S1 meters the volumes of paint flowed alternately into the reservoirs P and PP. Once a preselected volume of paint is metered into a reservoir, the valve on the color changer for that particular color of paint is closed. The color changer air valve U may then be briefly opened to insert an air bubble behind the paint column, following which the color changer water valve Q is opened to flow water through the flow meter S2, into and through the color changer, so that the paint column is pushed by water all the way to and into the reservoir being replenished. The flow meter S2 meters the volume of water used to push the paint column into the reservoir to ensure that sufficient water is used to push all or substantially all of the paint into the reservoir, but not so much that water enters the reservoir.

To meter and control the paint flow from the reservoirs to the spray device, the fiber optic flow meter S3 is located just upstream from the fluid pressure regulator R1 and is electrically isolated from ground by its electrically nonconductive fiber optic cable. The flow meter S3, a transducer I/P (amps to pressure), the fluid pressure regulator R1 and a flow computer control the total volume flow and volume flow rate of paint delivered to the spray gun from a reservoir. The output from the flow meter S3 is applied via the fiber optic cable as an input to the flow computer. An output from the flow meter S1 also is applied as an input to the flow computer. In response to the inputs from the flow meters S1 and S3, the flow computer generates at an output a current signal that is applied as an input to the transducer I/P. An output from the transducer I/P is an air pressure signal that is applied as the control signal A to the control input to the fluid regulator R1. The outputs from the flow meters S1 and S3 therefore effect control over the flow of paint through the fluid regulator R1 to the paint inlet to the spray device.

One function served by the flow meter S3 is to enable a comparison of ounces of paint loaded into a reservoir to ounces of paint delivered to the spray gun. The flow meter S1 accurately meters the amount of paint loaded into a reservoir and provides that information to the flow computer. The flow meter S3, in turn, meters the volume of paint delivered from the reservoir to the spray gun and provides that information to the flow computer. Thus, by use of the flow meter S3, it is possible to compare the amount of paint delivered to a reservoir to the amount of paint delivered to the spray gun in order to utilize substantially all of the paint in the reservoir and minimize wastage. In particular, the flow computer compares the input obtained from the flow meter S1 to the input from the flow meter S3, and when the volume of paint delivered from a reservoir to the spray device is substantially equal to but less by a predetermined amount than the volume of paint loaded into the reservoir, the flow computer causes the transducer I/P to apply to the input to the fluid regulator R! a control signal A that interrupts the flow of paint through the fluid regulator. It is therefore possible to empty the reservoir of paint, and to also nearly empty the fluid line of paint all the way to the flow meter S3, so that less than one ounce of paint per color is wasted.

Another function served by the flow meter S3 is to enable the volume flow rate of paint delivered to the spray gun to be monitored and controlled by means of variably controlling the air pressure at the control inlet to the fluid regulator R1. Previously, the air pressure control signal A was set at a constant value chosen to develop a selected pressure of paint at the fluid inlet to the spray gun, with the thought in mind that the selected pressure of paint would result in a predetermined and constant flow rate of paint to the gun. However, since various factors other than pressure influence the flow rate of paint into the gun, the technique was less than satisfactory in accurately controlling the paint flow rate. With the present invention, the flow meter S3 constantly monitors the volume flow rate of the paint and generates an output in accordance with the flow rate. The output from the flow meter S3 is applied to the flow computer, causing the flow computer to generate an output having a value in accordance with the paint flow rate. The output from the flow computer is applied to the input to the transducer I/P, the output from which controls the air pilot pressure to the fluid regulator in a manner to maintain the volume flow rate of paint to the spray gun at a preselected value. The arrangement enables very accurate control over the volume flow rate of paint delivered to the spray gun.

The invention therefore provides, in a voltage block color change system of a type having a reservoir, means for minimizing the loss of paint incident to color changes and for accurately maintaining a preselected volume flow rate of paint to a spray device during a spraying operation.

While one embodiment of the invention has been described in detail, various modifications and other embodiments thereof may be devised by one skilled in the art without departing from the spirit and scope of the invention, as defined in the appended claims.

What is claimed is:

1. A system for supplying electrically conductive coating material to high voltage electrostatic coating apparatus, said system comprising means for supplying conductive coating material; a reservoir; means for coupling said supplying means to said reservoir; means for flowing coating material from said supplying means through said coupling means into said reservoir; first metering means for metering the volume of coating material flowed from said supplying means into said reservoir; means, operative after coating material is flowed into said reservoir, for cleaning coating material from at least a portion of said coupling means to electrically isolate said reservoir and coating material therein from said supplying means; means, operative after said reservoir has been electrically isolated from said supplying means, for flowing coating material from said reservoir to the coating apparatus for being electrostatically charged and emitted thereby; second metering means for metering the volume of coating material flowed from said reservoir to the coating apparatus; and means responsive to said first and second metering means for interrupting the flow of coating material from said reservoir to the coating apparatus upon said second metering means metering a selected volume flow of coating material from said reservoir to the coating apparatus.

2. A system as in claim 1, wherein said means for interrupting is responsive to said second metering means metering a volume flow of coating material from said reservoir that substantially but not quite equals the volume of coating material flowed from said supplying means into said reservoir as metered by said first metering means.

3. A system as in claim 1, including means for comparing the volume flows of coating material metered by said first and second metering means, said interrupting means being responsive to the volume flow metered by said second metering means being a predetermined amount less than the volume flow metered by said first metering means to interrupt the flow of coating material from said reservoir to the coating apparatus.

4. A system as in claim 1, including means for adjustably controlling the volume flow rate of coating material from said reservoir to the coating apparatus, said second metering means also metering volume flow rate of coating material flowed from said reservoir and being coupled to said adjustably controlling means to adjustably operate the same to maintain a selected volume flow rate of coating material to the coating apparatus.

5. A system for supplying electrically conductive coating materials to high voltage electrostatic coating apparatus, comprising a color changer having inlets for connection with respective ones of a plurality of supplies of the coating materials and an outlet for the materials; a pair of reservoirs; coupling means for selectively connecting said color changer outlet to one or the other of said reservoirs; means for operating said color changer and said coupling means to flow coating materials from selected ones of the supplies from said color changer outlet into and through said coupling means alternately to and into one and then the other of said reservoirs; first metering means for metering the volume flows of coating materials flowed into one and then into the other of said reservoirs; means for cleaning coating material from at least a portion of said coupling means between said color changer outlet and whichever reservoir coating material has just been flowed into, to electrically isolate such reservoir and coating material therein from said color changer and the supplies of coating material; means for alternately flowing coating material from one and then from the other of said reservoirs to the coating apparatus for electrostatic charging and emission of the coating material by the coating apparatus, such that coating material in the reservoir that has just been filled and electrically isolated from the color changer and coating material supplies is flowed to the coating apparatus while the other reservoir is being filled with coating material and then electrically isolated from said color changer and coating material supplies; second metering means for metering the volume flows of coating materials flowed from one and then from the other of said reservoirs to the coating apparatus; means responsive to said first and second metering means for interrupting the flow of coating material from a reservoir to the coating apparatus upon said second metering means metering a preselected volume flow of coating material from such reservoir to the coating apparatus; and means, responsive upon interruption of the flow of coating material from one reservoir to the coating apparatus and prior to flowing coating material from the other reservoir to the coating apparatus, for cleaning coating material from at least a portion of said means for alternately flowing, between the coating apparatus and the reservoir from which coating material has just been flowed, to electrically isolate such reservoir from the coating apparatus.

6. A system as in claim 5, wherein said means for interrupting is responsive to said second metering means metering a volume flow of coating material from a reservoir that substantially but not quite equals the volume of coating material flowed into such reservoir as metered by said first metering means.

7. A system as in claim 5, including means for comparing the volume flows of coating material metered by said first and second metering means, said interrupting means being responsive to the volume flow of coating material from a reservoir, as metered by said second metering means, being a predetermined amount less than the volume flow of coating material flowed into such reservoir, as metered by said first metering means, to interrupt the flow of coating material from such reservoir to the coating apparatus.

8. A system as in claim 5, including means for adjustably controlling the volume flow rate of coating material from a reservoir to the coating apparatus, said second metering means also metering the volume flow rate of coating material from a reservoir to the coating apparatus and being coupled to said adjustably controlling means to operate said adjustably controlling means to maintain a selected volume flow rate of coating material to the coating apparatus.

9. A method of supplying electrically conductive coating material to high voltage electrostatic coating apparatus from a coating material supply, while maintaining electrical isolation between the high voltage at the coating apparatus and the coating material supply, said method comprising the steps of coupling the coating material supply to a reservoir through a supply path; connecting the reservoir to the coating apparatus through a delivery path; flowing coating material from the coating material supply into and through the supply path to and into the reservoir; measuring the volume of coating material flowed through the supply path into the reservoir; after flowing coating material into the reservoir, cleaning coating material from at least a portion of the supply path to electrically isolate the reservoir and coating material therein from the coating material supply; after completion of said cleaning step, delivering coating material in the reservoir through the delivery path to the coating apparatus for being electrostatically charged and emitted by the coating apparatus; metering the volume of coating material delivered from the reservoir to the coating apparatus; and, in response to said measuring and said metering steps, interrupting delivery of coating material from the reservoir to the coating apparatus upon metering a selected volume of coating material delivered from the reservoir to the coating apparatus.

10. A method as in claim 9, wherein said interrupting step is performed in response to the metered volume of coating material delivered from the reservoir being substantially but not quite equal to the measured volume of coating material flowed into the reservoir.

11. A method as in claim 9, including the step of comparing the measured and the metered volumes of coating material, said interrupting step being performed in response to the metered volume of coating material being a predetermined amount less than the measured volume of coating material.

12. A method as in claim 9, wherein said metering step also meters the volume flow rate of coating material delivered from the reservoir to the coating apparatus, and including the step, responsive to said metering step, of controlling the volume flow rate of coating material delivered from the reservoir to maintain a selected volume flow rate of coating material delivered to the coating apparatus.

13. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to first and second reservoirs through respective first and second supply paths; connecting the first and second reservoirs to the coating apparatus through respective first and second delivery paths; flowing coating materials from selected ones of the coating material supplies from the color changer outlet alternately to and into the first and second reservoirs through the respective first and second supply paths; measuring the volume flows of coating materials flowed into the first and second reservoirs; after flowing coating material into a reservoir, electrically isolating such reservoir and coating material in it from the color changer and coating material supplies by cleaning coating material from at least a portion of its respective supply path; while flowing coating material into one reservoir and then electrically isolating such reservoir and coating material in it from the color changer and coating material supplies, delivering coating material from the other reservoir through its respective delivery path to the coating apparatus for being electrostatically charged and emitted by the coating apparatus; metering the volume of coating liquid delivered from a reservoir to the coating apparatus; in response to said measuring and metering steps, interrupting delivery of coating material from a reservoir to the coating apparatus upon metering a predetermined volume flow of coating material from such reservoir; upon interruption of delivery of coating material from a reservoir to the coating apparatus, electrically isolating such reservoir from the coating apparatus by cleaning coating material from at least a portion of its respective delivery path; upon electrical isolation of a reservoir from the coating apparatus, delivering coating material from the other reservoir through its respective delivery path to the coating apparatus for being electrostatically charged and emitted by the coating apparatus; upon completion of electrical isolation of a reservoir from the coating apparatus, cleaning such reservoir before flowing the next selected color of coating material into it.

14. A method as in claim 13, wherein said interrupting step is performed in response to the metered volume of coating material delivered from a reservoir being substantially but not quite equal to the measured volume of coating material flowed into such reservoir.

15. A method as in claim 13, including the step of comparing the measured volume of coating material flowed into a reservoir to the metered volume of coating material delivered from such reservoir, said interrupting step being performed in response to the metered volume of coating material delivered from a reservoir being a predetermined amount less than the measured volume of coating material flowed into such reservoir.

16. A method as in claim 13, wherein said metering step also meters the volume flow rate of coating material delivered from a reservoir to the coating apparatus, and including the step of controlling the volume flow rate of coating material flowed from a reservoir to the coating apparatus to maintain a selected metered volume flow rate of coating material delivered from such reservoir.

* * * * *